US010252547B2

(12) United States Patent
Suda et al.

(10) Patent No.: US 10,252,547 B2
(45) Date of Patent: Apr. 9, 2019

(54) PRINTING PRESS

(71) Applicant: Komori Corporation, Tokyo (JP)

(72) Inventors: Hiroyuki Suda, Yamagata (JP); Hirotaka Kiyota, Tokyo (JP)

(73) Assignee: KOMORI CORPORATION, Tokyo (JP)

( * ) Notice: Subject to any disclaimer, the term of this patent is extended or adjusted under 35 U.S.C. 154(b) by 1 day.

(21) Appl. No.: 15/171,150

(22) Filed: Jun. 2, 2016

(65) Prior Publication Data

US 2016/0355028 A1 Dec. 8, 2016

(30) Foreign Application Priority Data

Jun. 5, 2015 (JP) ..... 2015-114514

(51) Int. Cl.

| | |
|---|---|
| ***B41F 27/12*** | (2006.01) |
| ***B41J 11/00*** | (2006.01) |
| ***B41J 13/22*** | (2006.01) |
| ***B41J 11/04*** | (2006.01) |
| ***B41J 29/377*** | (2006.01) |

(52) U.S. Cl.
CPC ..... *B41J 11/002* (2013.01); *B41J 11/04* (2013.01); *B41J 13/226* (2013.01); *B41J 29/377* (2013.01)

(58) Field of Classification Search
CPC combination set(s) only.
See application file for complete search history.

(56) References Cited

U.S. PATENT DOCUMENTS 4,402,267 A * 9/1983 DeMoore ..... B41F 22/00 101/419
4,856,428 A * 8/1989 Green ..... B41F 15/0827 101/116
5,511,480 A * 4/1996 DeMoore ..... B41F 22/00 101/419
6,074,056 A * 6/2000 Kubo ..... B41J 13/226 347/104
6,119,597 A * 9/2000 DeMoore ..... B41F 22/00 101/232
6,357,869 B1 * 3/2002 Rasmussen ..... B41J 11/0025 271/196
6,581,517 B1 * 6/2003 Becker ..... B41F 13/18 101/389.1
6,983,692 B2 * 1/2006 Beauchamp ..... B41J 13/226 101/389.1
7,963,224 B2 * 6/2011 Barinaga ..... B41J 13/226 101/407.1
8,220,388 B2 * 7/2012 DeMoore ..... B41F 22/00 101/401.1
8,578,853 B2 * 11/2013 DeMoore ..... B41F 21/10 101/415.1
8,794,147 B2 * 8/2014 DeMoore ..... B41F 22/00 101/401.1
2005/0092200 A1 * 5/2005 Beauchamp ..... B41J 13/226 101/409
2009/0290008 A1 * 11/2009 Fukui ..... B41J 11/0015 347/104
2010/0154665 A1 * 6/2010 DeMoore ..... B41F 22/00 101/217
2010/0154667 A1 * 6/2010 DeMoore ..... B41F 30/04 101/420
2013/0265359 A1 * 10/2013 Sugaya ..... B41J 11/002 347/16

FOREIGN PATENT DOCUMENTS

| | | | |
|---|---|---|---|
| EP | 1 527 893 | A1 | 5/2005 |
| EP | 2 650 132 | A1 | 10/2013 |
| JP | 10-175338 | A | 6/1998 |
| JP | 2007-320242 | A | 12/2007 |
| JP | 2009-279795 | A | 12/2009 |
| JP | 2011-178547 | A | 9/2011 |
| JP | 2013-240989 | A | 3/2013 |
| JP | 2013-241272 | A | 12/2013 |

OTHER PUBLICATIONS

Search Report in European Application No. 16001263.9 dated Oct. 10, 2016. 7 pages.
Office Action received for Japanese Patent Application No. 2015-114514, dated Feb. 12, 2019, 7 pages (3 pages of English Translation and 4 pages of Office Action).

* cited by examiner

*Primary Examiner* — Matthew Luu
*Assistant Examiner* — Lily Kemathe
(74) *Attorney, Agent, or Firm* — Womble Bond Dickinson (US) LLP

(57) ABSTRACT

A printing press includes a printing cylinder, inkjet heads, and an ink drying lamp. A non-metal sheet is attached to an outer surface of the printing cylinder. The non-metal sheet includes a main body made of a non-metal material in a sheet-like shape, and a plurality of ventilation portions through which air passes in a thickness direction of the main body. This makes it possible to efficiently dissipate heat of the printing cylinder while preventing the printing cylinder from being overheated when an amount of heat generated at the time of printing is transferred to the surface of the printing cylinder.

6 Claims, 6 Drawing Sheets

PRINTING PRESS

BACKGROUND OF THE INVENTION

The present invention relates to a printing press including inkjet heads for spraying ink on a sheet.

For example, Japanese Patent Laid-Open No. 2013-240989 (literature 1) discloses an example of a digital printing apparatus including inkjet heads. The digital printing apparatus disclosed in literature 1 includes an ink drying device for drying ink applied, by the inkjet heads, to a sheet to be printed. This ink drying device is controlled based on the convey state of the sheet. The ink drying device irradiates the sheet with light such as infrared or ultraviolet rays to dry ink by thermal energy. This digital printing apparatus executes printing by raising the surface temperature of the sheet to a predetermined temperature.

The digital printing apparatus disclosed in literature 1, however, poses a problem that infrared or ultraviolet rays for drying ink heat the surface of a printing cylinder for conveying the sheet, which excessively raise the surface temperature of the sheet. If the surface temperature of a sheet becomes too high, the viscosity of ink changes, thereby degrading the image quality of a printing product.

This problem can be solved to some extent by cooling the printing cylinder by a water or oil cooling device. However, this type of cooling device is difficult to control since the output is very large, and the device is large in size. Furthermore, since the rise time is long and a coolant may leak, the apparatus is difficult to deal with. Therefore, it is required to readily cool the printing cylinder without using such type of cooling device.

SUMMARY OF THE INVENTION

It is an object of the present invention to efficiently dissipate the heat of a printing cylinder while preventing the printing cylinder from being overheated when an amount of heat generated at the time of printing is transferred to the surface of the printing cylinder.

In order to achieve the above object of the present invention, there is provided a printing press including a printing cylinder configured to convey a sheet, an inkjet head configured to execute printing by discharging ink droplets to the sheet conveyed by the printing cylinder, a drying device opposing the printing cylinder and configured to dry printed ink, and a heat dissipation member overlaid and attached on an outer surface of the printing cylinder, the heat dissipation member including a main body made of a non-metal material in a sheet-like shape, and a plurality of ventilation portions through which air passes in a thickness direction of the main body.

DESCRIPTION OF THE PREFERRED EMBODIMENT

Figure 1:
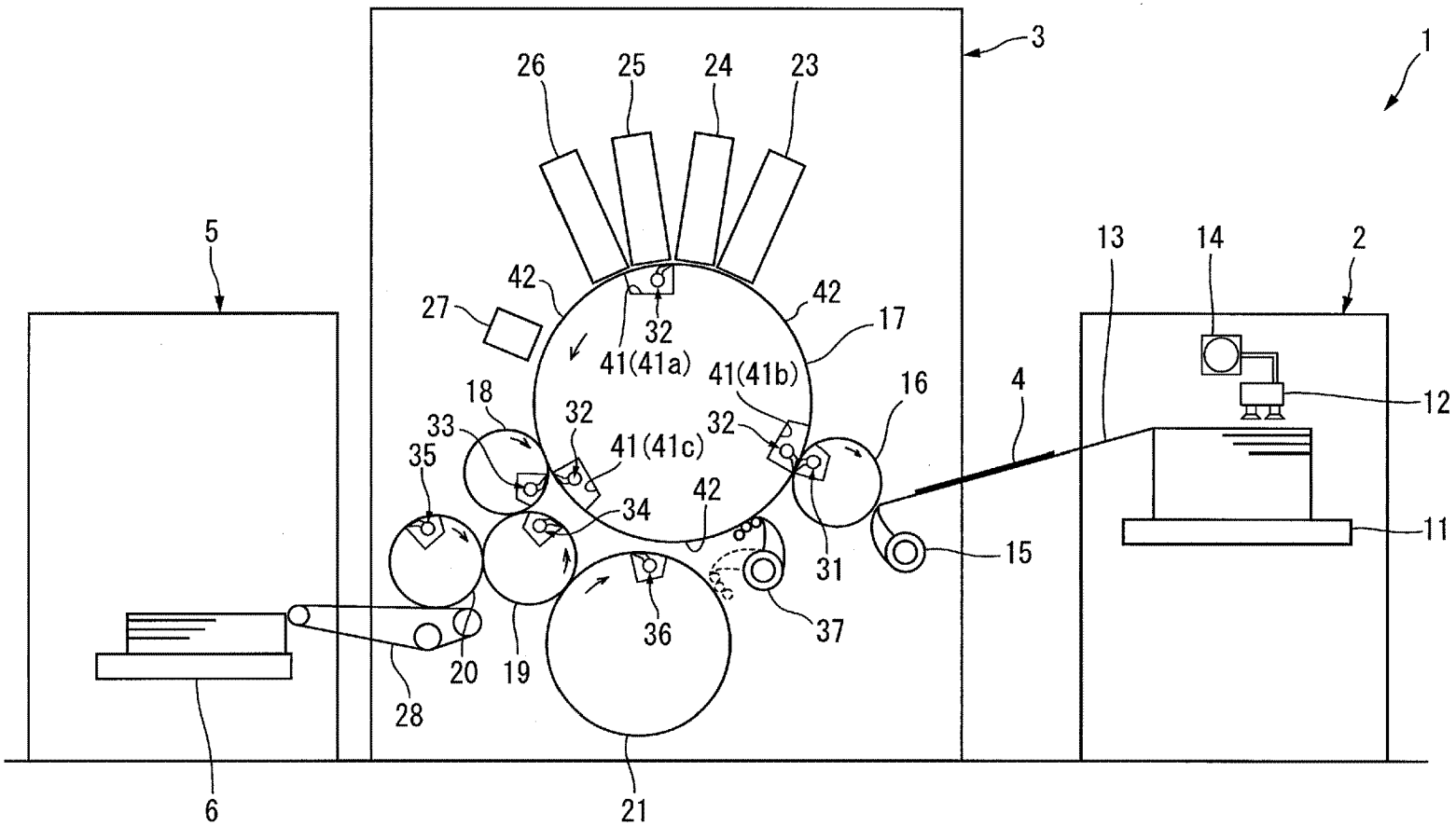
FIG. 1 is a side view showing the overall arrangement of a printing press according to an embodiment of the present invention.

An embodiment of a printing press according to the present invention will be described in detail below with reference to FIGS. 1 to 9. A printing press 1 shown in FIG. 1 conveys a sheet 4 as a printing product from a feeder unit 2 positioned at the rightmost position in FIG. 1 to a printing unit 3, and the printing unit 3 prints on one or two surfaces of the sheet 4. The sheet 4 printed by the printing unit 3 is fed to a delivery unit 5, and delivered to a delivery pile 6.

The feeder unit 2 has a structure of transferring the sheet 4 from a feeder pile 11 to a feeder board 13 by a sucker 12. The sucker 12 is connected to an intermittent sheet feed valve 14, and operates in one of a mode in which the sheets 4 are successively fed and a mode in which the sheets 4 are intermittently fed. If only the obverse surface of each sheet 4 is printed, the sucker 12 successively feeds the sheets 4 to the feeder board 13. On the other hand, if the obverse and reverse surfaces of each sheet 4 are printed, the sucker 12 intermittently feeds the sheets 4 to the feeder board 13.

The printing unit 3 includes a feed-side transfer cylinder 16 to which the sheet 4 fed from the feeder unit 2 is conveyed by a sheet feed-side swing device 15, a printing cylinder 17 to which the sheet 4 is fed from the feed-side transfer cylinder 16, and a plurality of transport cylinders 18 to 21 for feeding the printed sheet 4. The feed-side transfer cylinder 16 includes a heater (not shown) for heating the sheet 4 to a predetermined temperature. The printing cylinder 17 sucks and conveys the sheet 4, and includes a sucking device 22 (see FIG. 2) (to be described later).

The printing unit 3 further includes first to fourth inkjet heads 23 to 26 and an ink drying lamp 27, all of which oppose the printing cylinder 17. The first to fourth inkjet heads 23 to 26 are arranged on the downstream side of the feed-side transfer cylinder 16 in the sheet convey direction, and execute printing by discharging ink droplets to the sheet 4 conveyed by the printing cylinder 17. Note that the number of inkjet heads is not limited to four. The ink drying lamp 27 is arranged on the downstream side of the fourth inkjet head 26 in the convey direction, and dries (cures) printed ink which has been applied to the sheet 4 by the first to fourth inkjet heads 23 to 26. In this embodiment, the ink drying lamp 27 forms a "drying device" according to the present invention.

The above-described plurality of transport cylinders include the first delivery-side transfer cylinder 18 for receiving the sheet 4 from the printing cylinder 17, the second delivery-side transfer cylinder 19 for receiving the sheet 4 from the first delivery-side transfer cylinder 18, and the third delivery-side transfer cylinder 20 and pre-converting double-size cylinder 21 for receiving the sheet 4 from the second delivery-side transfer cylinder 19. The sheet 4 whose reverse surface is printed is conveyed from the second delivery-side transfer cylinder 19 to the pre-converting double-size cylinder 21. The sheet 4 whose obverse surface is printed or the sheet 4 whose obverse and reverse surfaces are printed is fed from the second delivery-side transfer cylinder 19 to the third delivery-side transfer cylinder 20, and then fed to the delivery pile 6 via a delivery belt 28.

The feed-side transfer cylinder 16, printing cylinder 17, first delivery-side transfer cylinder 18, second delivery-side transfer cylinder 19, third delivery-side transfer cylinder 20, and pre-converting double-size cylinder 21 include gripper devices 31 to 36 for transferring the sheet 4, respectively. These gripper devices 31 to 36 have a conventionally known structure of gripping and holding the downstream end portion of the sheet 4 in the convey direction.

A convertible swing device 37 for feeding the sheet 4 from the pre-converting double-size cylinder 21 to the printing cylinder 17 is arranged between the pre-converting double-size cylinder 21 and the feed-side transfer cylinder 16. The convertible swing device 37 grips the upstream end portion of the sheet 4 in the convey direction, which has been fed by the pre-converting double-size cylinder 21, and feeds the sheet 4 to the printing cylinder 17 while the obverse surface of the sheet 4 opposes the printing cylinder 17.

The outer portion of the printing cylinder 17 is formed by three gaps 41 (41*a* to 41*c*) each accommodating the gripper device 32, and three sheet support portions 42 each for sucking and holding the sheet 4. The three gaps 41 are formed at positions spaced apart from each other in the circumferential direction in the outer surface of the printing cylinder 17. More precisely, the three gaps 41 are formed at positions which divide the outer surface into three parts in the circumferential direction. Although details will be described later, the three sheet support portions 42 are formed between the gaps 41. That is, the printing cylinder 17 is a triple-size cylinder including three pairs of gaps 41 and sheet support portions 42.

Figure 2:
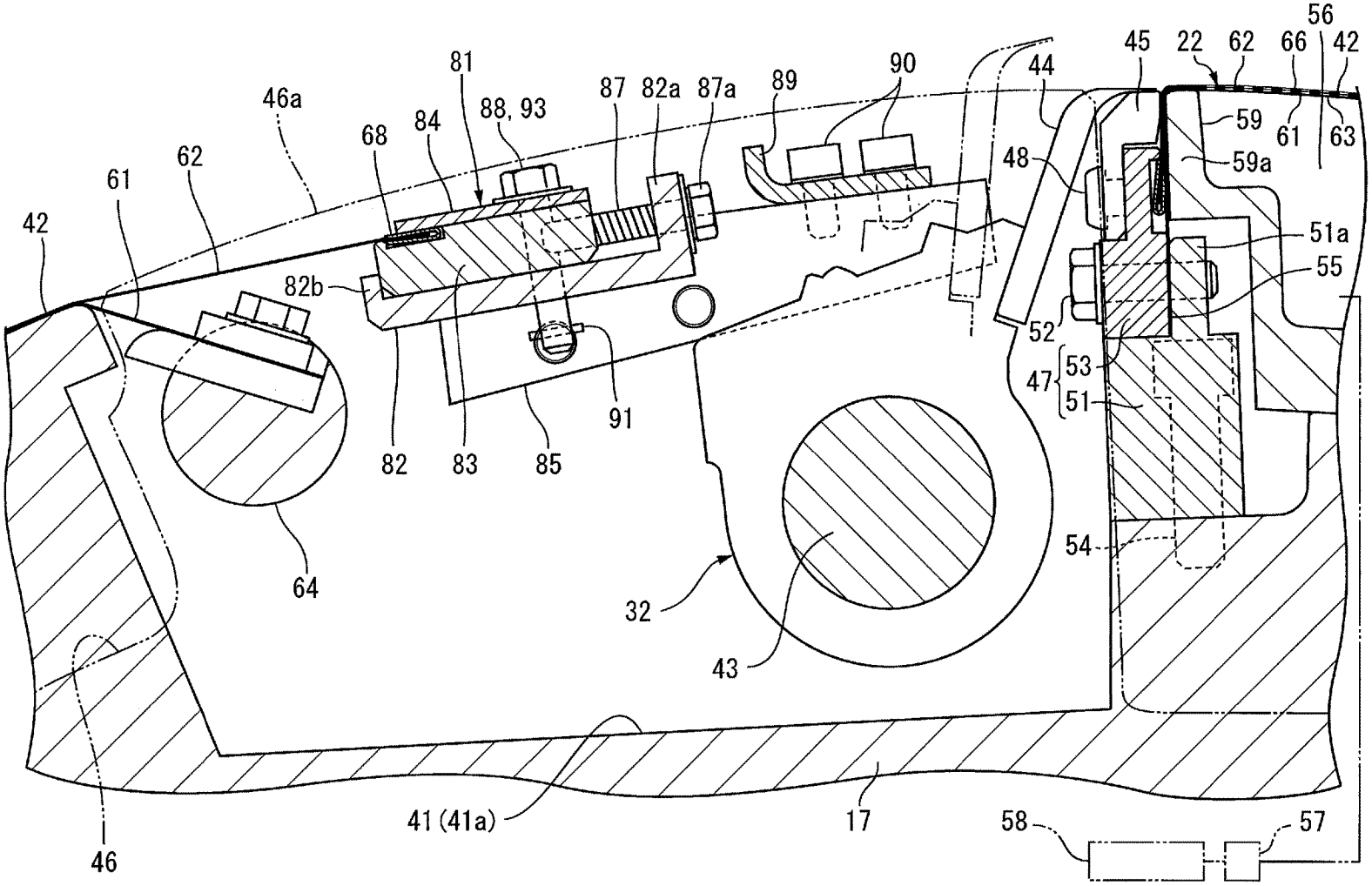
FIG. 2 is an enlarged sectional view showing a gap formed in an outer surface of a printing cylinder.

As shown in FIG. 2, each gripper device 32 of the printing cylinder 17 is formed by a gripper shaft 43, a gripper member 44 disposed in the gripper shaft 43, a gripper receiving portion 49 for gripping the sheet 4 together with the gripper member 44, and the like. The gripper shaft 43, gripper member 44, and gripper receiving portion 49 are disposed in the gap 41 formed in the outer surface of the printing cylinder 17.

The gripper shaft 43 extends from one end portion of the printing cylinder 17 to the other end portion in the axial direction in parallel to the axis (rotation axis) of the printing cylinder 17, and is rotatably supported by support plate members 46*a* of support plates 46 (see FIG. 9) attached to the two end portions of the printing cylinder 17. Each support plate member 46*a* is a portion which is formed in the outer portion of the support plate 46 to protrude outward in the radial direction, and is disposed at each of three positions, in the circumferential direction, corresponding to the gaps 41. Each support plate member 46*a* is formed in a shape to cover the corresponding gap 41 from the outside of the printing cylinder 17 in the axial direction. The gripper shaft 43 is driven by a conventionally well-known cam mechanism (not shown), and pivots at a predetermined time.

The gripper member 44 is disposed at each of a plurality of positions in the axial direction of the corresponding gripper shaft 43. The gripper member 44 moves between a gripping position indicated by solid lines in FIG. 2 and a release position indicated by two-dot dashed lines in FIG. 2 when the gripper shaft 43 pivots.

The gripper receiving portion 49 includes a gripper pad 45 for sandwiching the sheet 4 in cooperation with the gripper member 44, and a gripper pad shaft 47 for detachably holding the gripper pad 45. The gripper pad 45 is fixed by a fixing bolt 48 while it is placed on the distal end portion of the gripper pad shaft 47 attached to the gap 41. In this embodiment, the gripper pad shaft 47 is formed by a support member 51 which protrudes outward in the radial direction of the printing cylinder 17 from the bottom of the gap 41, and a holding member 53 which is fixed by a fixing bolt 52 while it is overlaid on a protruded end portion 51*a* of the support member 51. The support member 51 and the holding member 53 extend from one end portion of the printing cylinder 17 to the other end portion in the axial direction in parallel to the axis of the printing cylinder 17. The support member 51 is fixed to the bottom of the gap 41 by a fixing bolt 54. An abutting surface 55 between the holding member 53 and the protruded end portion 51*a* of the support member 51 extends in the radial and axial directions of the printing cylinder 17.

As shown in FIG. 2, a suction chamber 56 serving as part of the sucking device 22 is formed in each of the three sheet support portions 42 of the printing cylinder 17. The sucking device 22 sucks, toward the outer surface of the printing cylinder 17, the sheet 4 conveyed by the printing cylinder 17. The sucking device 22 includes the suction chamber 56, and an air suction device 58 connected to the suction chamber 56 via an opening/closing valve 57. The suction chamber 56 is formed in a box-shaped member 59 disposed in the outer portion of the printing cylinder 17. The box-shaped member 59 opens outward in the radial direction of the printing cylinder 17. The opening portion of the box-shaped member 59 is covered with a metal sheet 61 and a non-metal sheet 62.

The metal sheet 61 is obtained by forming a number (a plurality) of ventilation holes 63 in a sheet made of stainless steel or the like. The metal sheet 61 is formed in a shape to cover the entire region of each sheet support portion 42, and the two end portions of the metal sheet 61 are fixed to the printing cylinder 17. The two end portions indicate the upstream and downstream end portions in the sheet convey direction. The downstream end portion of the metal sheet 61 in the sheet convey direction is folded inside in the radial direction of the printing cylinder 17 along an end portion 59*a* of the box-shaped member 59 in the gap 41 (41*a*) shown in FIG. 2, and sandwiched by the holding member 53 and the protruded end portion 51*a* of the support member 51, which have been described above. The upstream end portion of the metal sheet 61 is fixed to a sheet holding shaft 64 disposed in the gap 41 (41*b*) separated from the gap 41 (41*a*) shown in FIG. 2 on the upstream side in the sheet convey direction. The sheet holding shaft 64 shown in FIG. 2 supports the end portion of the metal sheet 61 covering the sheet support portion 42 between the gap 41 (41*a*) and the gap 41 (41*c*) separated on the downstream side.

Figure 7:
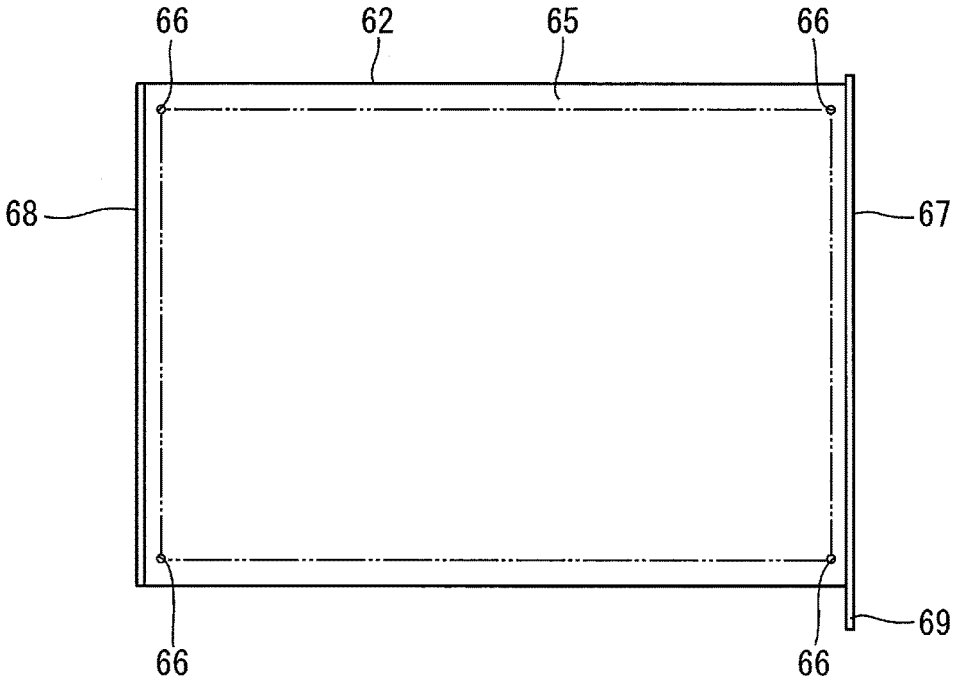
FIG. 7 is a plan view showing a non-metal sheet.
Figure 8:
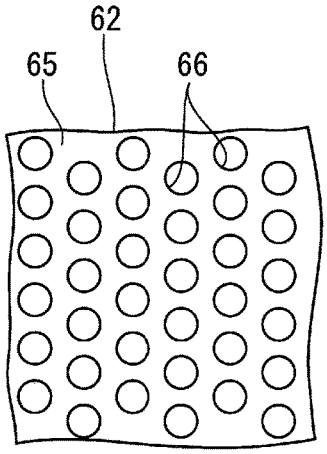
FIG. 8 is an enlarged plan view showing part of the non-metal sheet.

The non-metal sheet 62 forms a "heat dissipation member" according to the present invention. This non-metal sheet 62 includes a main body 65 formed in a sheet-like shape using a non-metal material, and a number (a plurality) of ventilation portions 66 through which air passes in the thickness direction of the main body 65, as shown in FIGS. 7 and 8. The main body 65 is made of a material which has high heat resistance, UV resistance, and solvent resistance while having strength so as not to stretch due to heat and an appropriate tensile strength. The material used to form the main body 65 according to this embodiment is PFA (tetrafluoroethylene-perfluoroalkyl vinyl ether copolymer). The thickness of the main body 65 desirably falls within the range of 0.07 mm (inclusive) to 0.5 mm (inclusive) and, more specifically, the range of 0.1 mm to 0.3 mm.

Figure 3:
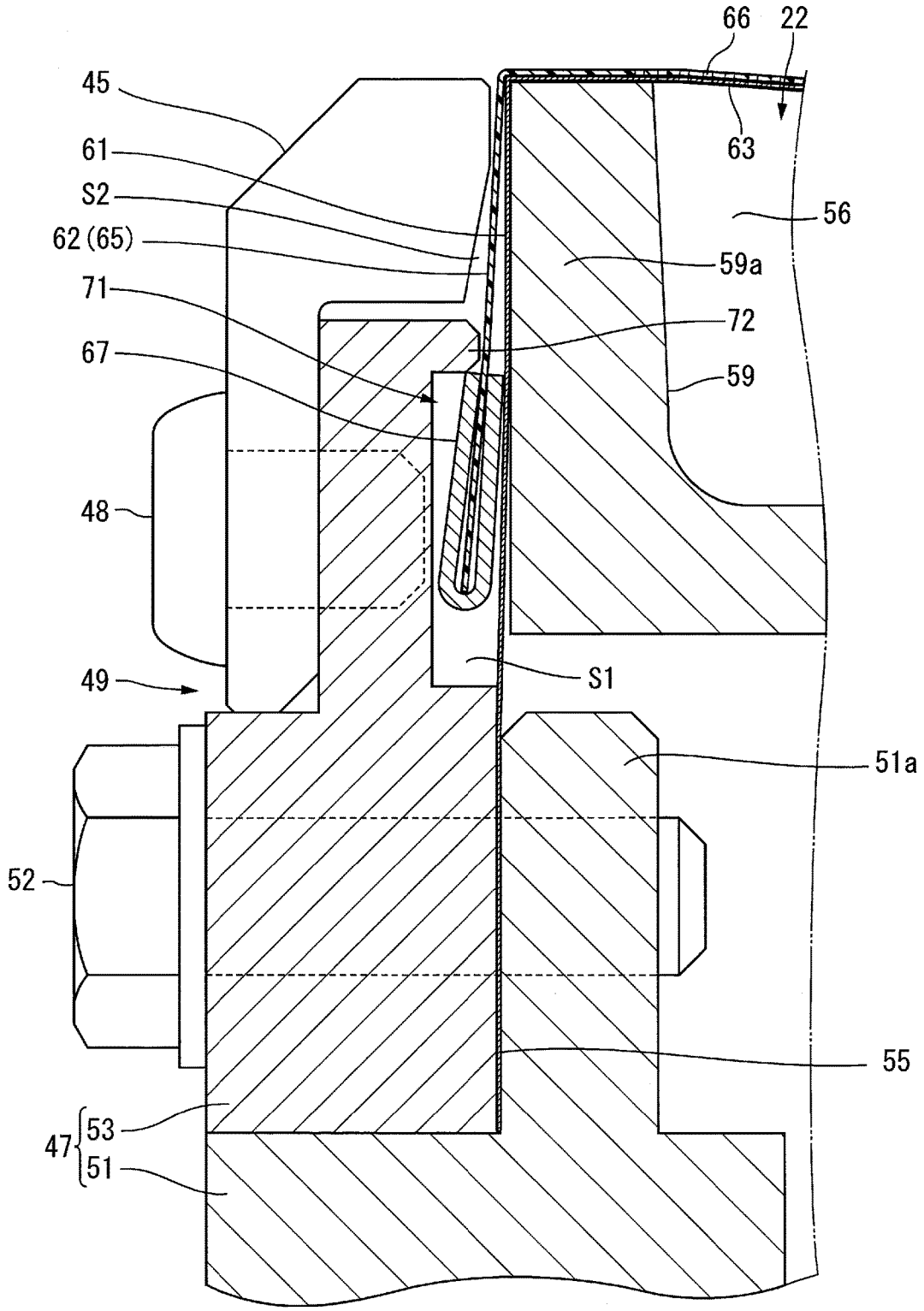
FIG. 3 is an enlarged sectional view showing a main part.

Bases 67 and 68 are disposed in the two end portions of the main body 65. The two end portions indicate those in the right-and-left direction in FIG. 7 and, more precisely, the downstream end portion (one end portion) and the upstream end portion (the other end portion) in the sheet convey direction. The base 67 positioned in the downstream end portion of the main body 65 in the sheet convey direction will be referred to as the first base 67 hereinafter, and the base 68 positioned in the upstream end portion will be referred to as the second base 68 hereinafter. As shown in FIG. 3, each of the first base 67 and the second base 68 is formed to have a thickness larger than that of the main body 65 of the non-metal sheet 62, and extends from one end of the non-metal sheet 62 to the other end in the axial direction of the printing cylinder 17. As shown in FIG. 7, a handle 69 protruding from one end of the printing cylinder 17 in the axial direction is formed in the first base 67.

Each ventilation portion 66 is formed by a through hole which extends through the main body 65 in the thickness direction. The opening shape of each ventilation portion 66 is a circle, as shown in FIG. 8. The adjacent ventilation portions 66 are not connected. The ventilation portions 66 are formed in the main body 65 in the axial direction of the printing cylinder 17 and in the sheet convey direction at predetermined intervals. In this embodiment, as indicated by two-dot dashed lines in FIG. 7, the ventilation portions 66 are formed over almost the entire region of the main body 65. The diameter of each ventilation portion 66 desirably falls within the range of 0.2 mm (inclusive) to 1 mm (inclusive) and, more specifically, the range of 0.3 mm to 0.9 mm. The formation pitch of the ventilation portions 66 is desirably equal to or smaller than 1.3 mm and, more specifically, falls within the range of 0.5 mm to 1.1 mm. Furthermore, a porosity preferably falls within the range of 50% (inclusive) to 70% (inclusive). The porosity indicates the ratio of the opening area of all the ventilation portions 66 to the total area of the main body 65.

The thus formed non-metal sheet 62 is attached to the printing cylinder 17 using the first base 67 and the second base 68 while it is overlaid on the above-described metal sheet 61 (the outer surface of the printing cylinder 17). As shown in FIG. 3, the first base 67 provided in one end portion of the non-metal sheet 62 is held by a first holding unit 71 disposed between the gripper receiving portion 49 and the end portion 59*a* of the box-shaped member 59. As shown in FIG. 2, the end portion 59*a* of the box-shaped member 59 forms a side wall which extends in the radial direction of the printing cylinder 17 on the upstream side in the sheet convey direction in the gap 41.

As shown in FIG. 3, the first holding unit 71 includes a space S1 in which the first base 67 is inserted while the non-metal sheet 62 extends inward in the radial direction of the printing cylinder 17 from the outer surface side of the printing cylinder 17. The first holding unit 71 also includes an abutment wall 72 which opposes, from the outside (the upper side in FIG. 3) in the radial direction of the printing cylinder 17, the first base 67 inserted in the space S1. In this embodiment, the abutment wall 72 is formed in the holding member 53 of the gripper pad shaft 47. In this case, a concave portion where the space S1 is formed exists in the surface, opposing the box-shaped member 59, of the holding member 53. The upper end portion of the concave portion serves as the abutment wall 72. Since the first base 67 positioned in the first holding unit 71 opposes the abutment wall 72, it cannot move to the outside in the radial direction of the printing cylinder 17. In other words, the abutment wall 72 restricts the movement of the first base 67 to the outside in the radial direction of the printing cylinder 17.

Figure 9:
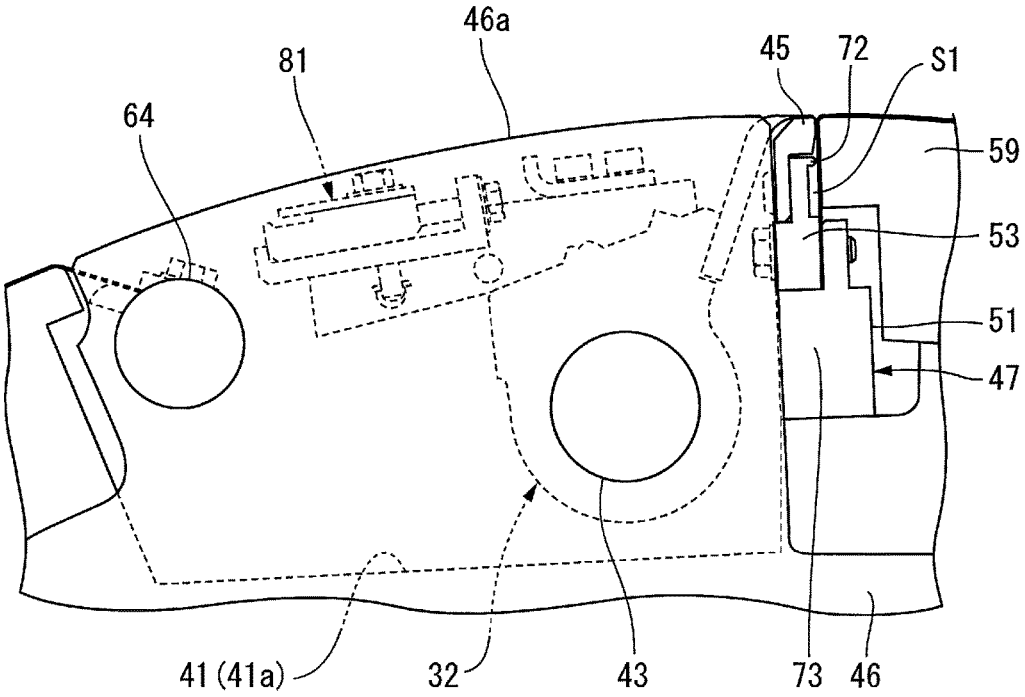
FIG. 9 is a side view showing part of an end portion of the printing cylinder in the axial direction.

As shown in FIG. 9, a space S2 between the gripper pad 45 and the space S1 and the end portion 59*a* of the box-shaped member 59 communicates with a release portion 73 formed in the end portion of the printing cylinder 17 in the axial direction. The release portion 73 is formed on the upstream side (the right side in FIG. 9) of the support plate member 46*a* of the support plate 46 in the sheet convey direction, and opens in the axial direction of the printing cylinder 17. Therefore, the end portions of the spaces S1 and S2 in the axial direction of the printing cylinder 17 are released to the outside. The spaces S1 and S2 can be visually perceived by seeing the printing cylinder 17 from the axial direction.

The second base 68 disposed in the other end portion of the non-metal sheet 62 is held by a second holding unit 81. The second holding unit 81 is disposed in the gap 41 (41*b*) separated, on the upstream side in the sheet convey direction, from the gap 41 (41*a*) where the first holding unit 71 for holding the first base 67 is disposed. The second holding unit 81 in the gap 41 (41*b*) has the same structure as that of the second holding unit 81 in the gap 41 (41*a*) shown in FIG. 2. That is, the second holding unit 81 includes a guide member 82 extending in the axial direction of the printing cylinder 17 in the gap 41, a slider 83 movably supported by the guide member 82, and a cover plate 84 for sandwiching the second base 68 in cooperation with the slider 83.

The guide member 82 extends from one end portion of the printing cylinder 17 to the other end portion in the axial direction, and is formed to have a groove-shaped cross-section with a pair of ribs 82*a* and 82*b*. The rib 82*a* is provided in the downstream end portion of the guide member 82 in the sheet convey direction, and the rib 82*b* is provided in the upstream end portion of the guide member 82 in the sheet convey direction. The guide member 82 is fixed, by a support bracket 85 and fixing bolts 86 (see FIG. 4), to the support plates 46 provided in the two end portions of the printing cylinder 17 in the axial direction.

The slider 83 is formed in a plate shape extending in the axial direction of the printing cylinder 17 along the guide member 82. The slider 83 is attached to the guide member 82 by two kinds of bolts. The two kinds of bolts are an adjusting bolt 87 extending in the sheet convey direction and a fixing bolt 88 extending in the radial direction of the printing cylinder 17.

The adjusting bolt 87 rotatably extends through the rib 82*a* of the guide member 82, and is threadably engaged with the slider 83. The adjusting bolt 87 positions the slider 83 in the sheet convey direction with reference to the guide member 82. In this embodiment, a stopper 89 (see FIG. 2) is disposed at a position opposing a head 87*a* of the adjusting bolt 87, that is, on the upstream side of the guide member 82 in the sheet convey direction. The stopper 89 extends in the axial direction of the printing cylinder 17 along the guide member 82, and is fixed to the above-described support bracket 85 by fixing bolts 90. Therefore, the adjusting bolt 87 can be loosened until the head 87a abuts against the stopper 89, and cannot be loosened any more after the head 87*a* abuts against the stopper 89.

Figure 5:
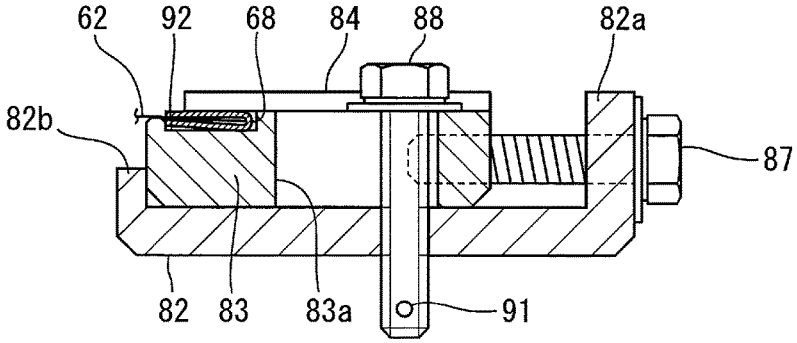
FIG. 5 is a sectional view taken along a line V-V in FIG. 4.

As shown in FIG. 5, the fixing bolt 88 extends through an elongated hole 83*a* of the slider 83, and is threadably engaged with the guide member 82. The fixing bolt 88 is arranged in each of the two end portions and central portion of the slider 83. The fixing bolts 88 fix the slider 83 to the guide member 82. The distal end portion of each fixing bolt 88 is provided with a removal prevention pin 91 extending to intersect the fixing bolt 88.

Figure 4:
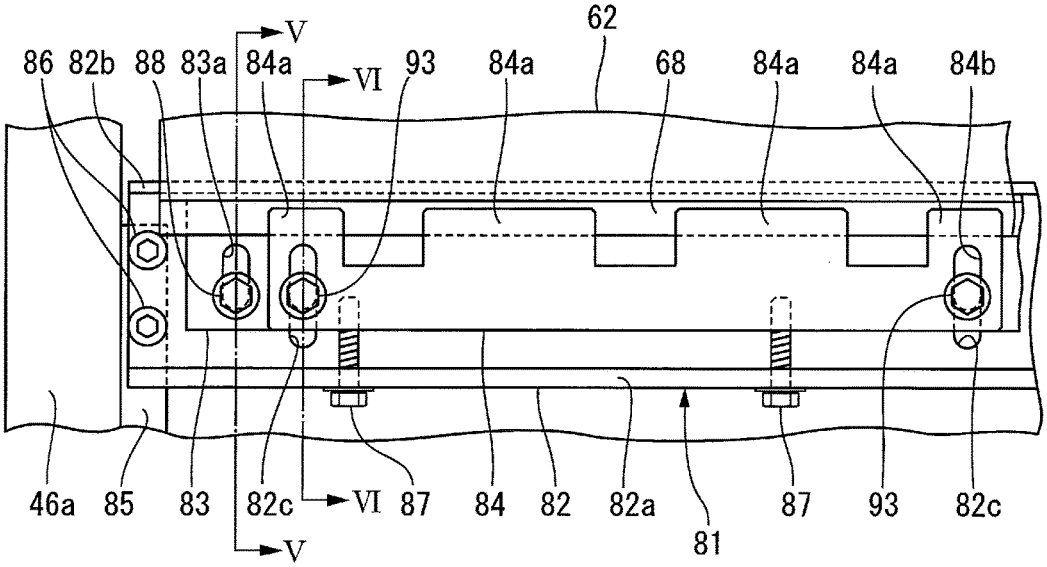
FIG. 4 is a plan view showing part of the printing cylinder.
Figure 6:
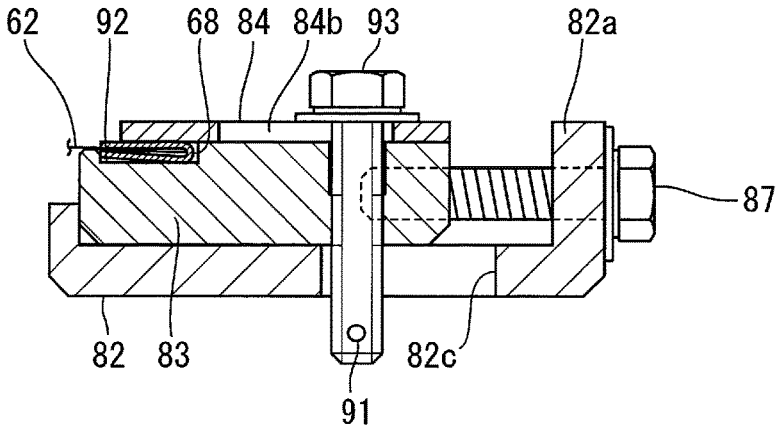
FIG. 6 is a sectional view taken along a line VI-VI in FIG. 4.

As shown in FIG. 6, a concave groove 92 in which the second base 68 is inserted is formed in the downstream end portion of the slider 83 in the sheet convey direction. As shown in FIG. 4, the cover plate 84 is formed in a band plate shape extending in the axial direction of the printing cylinder 17. A plurality of press portions 84*a* for pressing the second base 68 are formed in the cover plate 84. In this embodiment, a plurality of cover plates 84 arrayed in the axial direction of the printing cylinder 17 are arranged.

Each cover plate 84 is fixed to the slider 83 by fixing bolts 93 in the two end portions in the longitudinal direction while it is overlaid on the slider 83. As shown in FIG. 6, each fixing bolt 93 is threadably engaged with the slider 83 by extending through an elongated hole 84*b* of the cover plate 84. The distal end portion of the fixing bolt 93 is inserted through an elongated hole 82*c* of the guide member 82. The removal prevention pin 91 extending to intersect the fixing bolt 93 is also provided in the distal end portion of the fixing bolt 93.

A procedure of attaching the non-metal sheet 62 to the printing cylinder 17 will now be described. To attach the non-metal sheet 62 to the printing cylinder 17, one end portion of the first base 67 in the longitudinal direction is inserted from the outside of the printing cylinder 17 in the axial direction to the release portion 73 formed in one end portion of the printing cylinder 17 in the axial direction. This attachment operation and an operation of detaching the non-metal sheet 62 from the printing cylinder 17 can be readily performed by gripping the handle 69. The first base 67 is further moved in the axial direction, and is inserted to the space S1 of the first holding unit 71.

If the non-metal sheet 62 is pulled to the other end portion side while one end portion of the non-metal sheet 62 is inserted to the space S1, the first base 67 abuts against the abutment wall 72, and cannot move any more. Thus, when one end portion of the non-metal sheet 62 is inserted to the above-described space S1, the non-metal sheet 62 is held by the first holding unit 71 (printing cylinder 17) while one end portion of the non-metal sheet 62 is prevented from being removed.

After that, the main body 65 of the non-metal sheet 62 is overlaid on the sheet support portion 42 of the printing cylinder 17. The second base 68 is sandwiched by the cover plate 84 and the slider 83 of the second holding unit 81, thereby fixing the cover plate 84 to the slider 83 by the fixing bolts 93.

The adjusting bolt 87 is tightened to pull the non-metal sheet 62 together with the slider 83. When the non-metal sheet 62 is pulled, it is brought into tight contact with the metal sheet 61 (the outer surface of the printing cylinder 17). After that, while a predetermined tension acts on the non-metal sheet 62, the slider 83 is fixed to the guide member 82 using the fixing bolts 88. By fixing the slider 83 to the guide member 82, the operation of attaching the non-metal sheet 62 to the printing cylinder 17 is completed.

If the sucking device 22 operates while the non-metal sheet 62 is attached to the printing cylinder 17, the air passes through the ventilation portions 66 of the non-metal sheet 62 and the ventilation holes 63 of the metal sheet 61, and is sucked by the suction chamber 56, and thus the sheet 4 can be sucked to the non-metal sheet 62.

The printing press 1 performs a print operation while the sucking device 22 thus operates. Therefore, the sheet 4 is conveyed while it is sucked to the printing cylinder 17, and the first to fourth inkjet heads 23 to 26 spray ink on the sheet 4, thereby executing printing.

When the sheet 4 is fed to a position opposing the ink drying lamp 27, and irradiated with ultraviolet or infrared rays by the ink drying lamp 27, thereby drying (hardening) ink attached to the sheet 4. At this time, the surface of the sheet 4 is heated, and the heat is transferred from the sheet 4 to the non-metal sheet 62.

Since the non-metal sheet 62 is formed in a sheet-like shape having a number of ventilation portions 66, it has a small heat capacity and has a small contact area with the sheet 4. The non-metal sheet 62 absorbs the heat of the sheet 4 when opposing the ink drying lamp 27, and dissipates the heat when moving away from the ink drying lamp 27 by the rotation of the printing cylinder 17. Thus, the heat generated by the ink drying lamp 27 is temporarily absorbed by the non-metal sheet 62, and then dissipated. This means that the non-metal sheet 62 substantially functions as an adiabatic material, and makes it difficult to transfer, to the printing cylinder 17, heat generated at the time of printing or ink hardening. The ventilation portions 66 of the non-metal sheet 62 facilitate, during the rotation of the printing cylinder 17, dissipation of the heat of the non-metal sheet 62 transferred from the sheet 4 at the time of ink hardening.

Therefore, according to this embodiment, it is possible to provide a printing press which can, by a simple method, efficiently dissipate the heat of the printing cylinder 17 while preventing the printing cylinder 17 from being overheated when an amount of heat generated at the time of printing is transferred to the surface of the printing cylinder 17.

By adhering the non-metal sheet 62 to the printing cylinder 17, and executing printing, as described above, overheating of the printing cylinder 17 is suppressed and heat dissipation of the printing cylinder 17 is improved, thereby increasing the number of continuous printable sheets until the temperature of the printing cylinder 17 reaches the use limit. The cooling structure formed using the non-metal sheet 62 is simple and can be implemented at low cost, as compared with a water or oil cooling device (not shown).

In this embodiment, the printing cylinder 17 includes the sucking device 22 for sucking and conveying the sheet 4. The main body 65 of the non-metal sheet 62 is formed by a sheet made of a non-metal material. The ventilation portions 66 of the non-metal sheet 62 are formed by a number of through holes extending through the main body 65 in the thickness direction. Therefore, according to this embodiment, the sheet 4 is sucked to the non-metal sheet 62 by the sucking device 22. Since the diameter of each ventilation portion 66 falls within the range of 0.2 mm (inclusive) to 1 mm (inclusive), pressing against the opening edges of the ventilation portions 66 forms no marks on the sheet 4 sucked to the non-metal sheet 62. Therefore, according to this embodiment, it is possible to provide a printing press which provides high-quality printing products.

In this embodiment, the thickness of the main body 65 of the non-metal sheet 62 falls within the range of 0.7 mm (inclusive) to 0.5 mm (inclusive). Thus, since it is possible to suppress the heat capacity of the non-metal sheet 62 to a small capacity, the non-metal sheet 62 which readily absorbs and dissipates heat is obtained. Therefore, it is possible to provide a printing press in which the temperature of the printing cylinder 17 is further difficult to rise.

The above-described embodiment has explained an example in which the non-metal sheet 62 is made of PFA. However, the material used to form the non-metal sheet 62 is not limited to PFA, and may be another fluororesin, a synthetic resin material such as polyimide, carbon, or the like. As a method of forming the ventilation portions 66 in the non-metal sheet 62, punching, etching, a laser drilling method, or the like can be adopted.

The material used to form the non-metal sheet 62 may be obtained by braiding a wire such as a mesh or net material, instead of the synthetic resin material formed in a sheet-like shape. In this case, the ventilation portions 66 are formed by gaps formed in the material. As the mesh or net material for the main body 65, PFA, another fluororesin, polyimide, glass fiber, or the like can be used. The diameter of the material in this case desirably falls within the range of about 0.03 mm to about 0.5 mm, and the formation pitch desirably falls within the range of about 0.1 mm to about 1.5 mm. The material used to form the non-metal sheet 62 may be a resin foam.

What is claimed is:

1. A printing press comprising:

a printing cylinder including a metal sheet forming an outer surface of the printing cylinder and configured to convey a sheet;

an inkjet head configured to execute printing by discharging ink droplets to the sheet conveyed by the printing cylinder;

a drying device arranged on a downstream side of the inkjet head in a convey direction of the sheet, opposing the printing cylinder and configured to dry printed ink; and a heat dissipation member overlaid and attached on the metal sheet of the printing cylinder, absorbing heat of the sheet when opposing the drying device, and dissipating the heat when moving away from the drying device, the heat dissipation member including:

a main body made of a non-metal material in a sheet-like shape, and a plurality of ventilation portions through which air passes in a thickness direction of the main body, wherein the printing cylinder includes a first holding unit and a second holding unit for respectively detachably holding one end and another end of the heat dissipation member, and a third holding unit and a fourth holding unit for respectively holding one end and another end of the metal sheet.

2. The printing press according to claim 1, wherein the printing cylinder includes a sucking device configured to suck the sheet toward the outer surface, the non-metal material is a synthetic resin, each of the plurality of ventilation portions is formed by a through hole extending through the main body in the thickness direction, and a diameter of the through hole falls within a range of 0.2 mm to 1 mm, inclusive.

3. The printing press according to claim 1, wherein a thickness of the main body falls within a range of 0.07 mm to 0.5 mm, inclusive.

4. The printing press according to claim 1, wherein a ratio of an opening area of the plurality of ventilation portions to a total area of the main body falls within a range of 50% to 70%, inclusive.

5. The printing press according to claim 1, wherein the second holding unit includes an adjusting member configured to pull the heat dissipation member.

6. The printing press according to claim 1, wherein the printing cylinder includes a gripper device including a gripper member and a gripper pad, the gripper member and the gripper pad configured to grip only the sheet.

* * * * *